US007148620B2

(12) United States Patent
Nakamura et al.

(10) Patent No.: US 7,148,620 B2
(45) Date of Patent: Dec. 12, 2006

(54) IMAGE DISPLAY DEVICE

(75) Inventors: Tomoki Nakamura, Chiba (JP); Yuuichi Kijima, Chosei (JP); Yoshiyuki Kaneko, Hachioji (JP); Shigemi Hirasawa, Chiba (JP)

(73) Assignee: Hitachi Displays, Ltd., Mobara (JP)

( * ) Notice: Subject to any disclaimer, the term of this patent is extended or adjusted under 35 U.S.C. 154(b) by 340 days.

(21) Appl. No.: 10/701,125

(22) Filed: Nov. 5, 2003

(65) Prior Publication Data

US 2004/0090171 A1 May 13, 2004

(30) Foreign Application Priority Data

Nov. 7, 2002 (JP) ..... 2002-323640

(51) Int. Cl.
*H01J 29/0662* (2006.01)
*H01J 1/62* (2006.01)

(52) U.S. Cl. ..... 313/497

(58) Field of Classification Search ..... 313/422, 313/495, 496, 497; 315/366; 345/75.1, 345/75.2

See application file for complete search history.

(56) References Cited

U.S. PATENT DOCUMENTS 6,445,125 B1 * 9/2002 Na et al. ..... 313/497

2003/0168965 A1 * 9/2003 Kijima et al. ..... 313/495

* cited by examiner

*Primary Examiner*—Toan Ton
*Assistant Examiner*—Tai Duong
(74) *Attorney, Agent, or Firm*—Antonelli, Terry, Stout and Kraus, LLP.

(57) ABSTRACT

To realize a field emission type image display device which can obtain a high current density at low voltage driving, assuming a diagonal screen size of the display region as D(mm), the number of the pixels which are arranged in the x direction as Nh, the number of the pixels which are arranged in the y direction as Nv, the distance between the electron passing apertures formed in the strip-like electrode elements which constitute the control electrodes as db(mm), the distance between the electron source and the strip-like electrode element as Lkg(mm), and an aperture diameter of the electron passing apertures as ϕG(mm), provided that the aperture diameter ϕG(mm) is expressed by the following formula (45), $$\frac{D}{3\cdot\sqrt{Nh^2+Nv^2}}-2db>(-0.23\cdot\ln(db)+0.49)\cdot Lkg+0.02\cdot\ln(db)+0.125 \quad (45)$$

the following formula (46) is established.

$$(0.46\cdot\ln(db)+2.5)\cdot Lkg+0.006\cdot\ln(db)+0.04\leqq\phi G\leqq(-0.41\cdot\ln(db)-0.68)\cdot Lkg+0.014\cdot\ln(db)+0.145 \quad (46)$$

7 Claims, 15 Drawing Sheets a —— $Ds = 21400\ Lkg^3 - 815\ Lkg^2 + 9.92\ Lkg$ (MAX.)
b ---- $Ds = 7670\ Lkg^3 - 330\ Lkg^2 + 4.53\ Lkg$
c —·— $Ds = 2170\ Lkg^3 - 120\ Lkg^2 + 2.08\ Lkg$ (MIN.)

IMAGE DISPLAY DEVICE

BACKGROUND OF THE INVENTION

The present invention relates to an image display device which utilizes an emission of electrons into a vacuum space which is defined between two substrates; and, more particularly, the invention relates to an image display device which can produce a high-quality image display with low power consumption by leading out a current of high density from an electron source at a low voltage.

As a display device which exhibits high brightness and high definition, color cathode ray tubes have been widely used conventionally. However, along with the recent request for higher quality images in information processing equipment or television broadcasting, the demand for planar displays (panel displays) which are light in weight and require a small space, while exhibiting high brightness and high definition, has been increasing.

As typical examples, liquid crystal display devices, plasma display devices and the like have been put into practice. More particularly, as display devices which can realize higher brightness, it is expected that various kinds of panel-type display devices, including a display device which utilizes an emission of electrons from electron sources into a vacuum (hereinafter, referred to as "an electron emission type display device" or "a field emission type display device", hereinafter also referred to as an "FED"), and an organic EL display, which is characterized by low power consumption, will be commercialized.

Among such panel type display devices, such as an FED particularly, a display device having an electron emission structure as proposed by C. A. Spindt et al, a display device having an electron emission structure of a metal-insulator-metal (MIM) type, a display device having an electron emission structure which utilizes an electron emission phenomenon based on a quantum theory tunneling effect (also referred to as a "surface conduction type electron source"), and a display device which utilizes an electron emission phenomenon having a diamond film, a graphite film or carbon nanotubes, are known.

An FED includes a back substrate on which cathode lines are formed, having electron-emission-type electron sources disposed thereon, and control electrodes disposed on an inner surface thereof, and a face substrate having anodes and fluorescent materials formed on an inner surface which faces the back substrate, wherein both substrates are laminated to each other by inserting a sealing frame between inner peripheries of both substrates, and the inside space thereof is evacuated. Further, to set a gap between the back substrate and the face substrate to a given value, gap holding spacers may be provided between the back substrate and the face substrate. As relevant examples of this type of device, reference is made to Japanese Unexamined Patent Publication Hei 10(1998)-134701 and Japanese Unexamined Patent Publication 2000-306508.

SUMMARY OF THE INVENTION

In an FED, control electrodes, which have electron passing apertures, are formed between electron sources that are provided on cathode lines disposed on a back substrate, anodes are provided on a face substrate, and a given potential difference is established between the control electrodes and the cathode lines so as to cause electrons to be emitted from the electron sources, whereby the electrons are directed to the anode side through the electron passing apertures. The control electrodes are constituted of a large number of parallel strip-like electrode elements which are arranged close to the electron sources. The current density of the electrons emitted from the electron sources depends on an electric field that is generated between inner peripheries of the electron passing apertures formed in the strip-like electrode elements which constitute the control electrodes and the cathode lines. That is, it is not always possible to increase the current density even when the number of electron passing apertures is increased, the diameter of the electron passing apertures is increased or a high voltage is applied. Further, the current density per pixel cannot be increased even when the current which flows in the cathode lines is simply increased.

On the other hand, the strip-like electrode elements which constitute the control electrodes are formed in an extremely fine web shape; and, hence, it is desirable that the aperture diameter of the electron passing apertures is made as small as possible from the viewpoint of mechanical strength. However, when the aperture diameter of the electron passing apertures is made excessively small, since the absolute quantity of electrons being emitted is limited, there exists a limitation with respect to narrowing of the aperture diameter. Conventionally, no consideration has been given with respect to the aperture diameters of the electron passing apertures from such a viewpoint.

Accordingly, it is an object of the present invention to provide an image display device which can realize the acquisition of a high current density at a low voltage, while making the aperture diameter of electron passing apertures as small as possible, by defining the relationship between the aperture diameter of the electron passing apertures that are formed in the strip-like electrode elements which constitute the control electrodes and the current density.

To achieve the above-mentioned object, the present invention provides an image display device comprising: a rectangular face substrate, which has an inner surface on which anodes and fluorescent materials are formed, and on which a display region is formed having two parallel sides in one direction and two parallel sides in another direction which is orthogonal to the one direction; and, a back substrate, which has a plurality of cathode lines which extend in the above-mentioned one direction and are arranged in the above-mentioned other direction in parallel and have electron sources disposed thereon, and control electrodes which intersect the cathode lines in a non-contacting manner at least inside of the display region, extend in the above-mentioned other direction and are arranged in the above-mentioned one direction in parallel, thus forming pixels at intersections with the cathode lines on an inner surface thereof. The control electrodes are formed by arranging in parallel a plurality of mutually independent strip-like electrode elements each having a plurality of electron passing apertures which allow electrons from the electron sources to pass therethrough to the face substrate side, the back substrate being arranged to face the face substrate with a given gap therebetween. A sealing fram is interposed between the face substrat and the back substrate, while surrounding the display region, in such a way that the given gap is mentioned between the face substrate and the back substrate.

In the above-described image display device, assuming a diagonal screen size of the display region which is formed on the face substrate as D(mm), the number of the pixels which are arranged in one direction as Nh, the number of the pixels which are arranged in another direction as Nv, the distance between the electron passing apertures formed in the strip-like electrode elements which constitute the control electrodes as db(mm), the gap between the electron source and the strip-like electrode element as Lkg(mm), and an aperture diameter of the electron passing apertures as ϕG(mm), provided that the above-mentioned aperture diameter ϕG(mm) is expressed by the following formula (10), $$\frac{D}{3\cdot\sqrt{Nh^2+Nv^2}}-2db>(-0.23\cdot\ln(db)+0.49)\cdot Lkg+0.02\cdot\ln(db)+0.125 \quad (10)$$

$$(0.46\cdot\ln(db)+2.5)\cdot Lkg+0.006\cdot\ln(db)+0.04\leqq\phi G\leqq(-0.41\cdot\ln(db)-0.68)\cdot Lkg+0.014\cdot\ln(db)+0.145 \quad (11)$$

and, provided that the above-mentioned aperture diameter ϕG(mm) is expressed by the following formula (12):

$$\frac{D}{3\cdot\sqrt{Nh^2+Nv^2}}-2db\leq(-0.23\cdot\ln(db)+0.49)\cdot Lkg+0.02\cdot\ln(db)+0.125 \quad (12)$$

the following formula (13) is established:

$$\phi G\min\leq\phi G\leq\frac{D}{3\cdot\sqrt{Nh^2+Nv^2}}-2db \quad (13)$$

wherein the aperture diameter ϕGmin is expressed by the following formula (14)

$$\frac{3}{4}\left(\frac{D}{3\cdot\sqrt{Nh^2+Nv^2}}-2db\right) \quad (14)$$

or by the following formula (15):

$$(0.46\cdot\ln(db)+2.5)\cdot Lkg+0.006\cdot\ln(db)+0.04 \quad (15)$$

Further, in the case where the above-mentioned electron passing apertures have a slit shape (an elongated circular shape or an elongated rectangular shape) having a long diameter and a short diameter, the long diameter D1 (mm) of the electron passing apertures having the slit shape is expressed by a following formula (16):

$$Dl\leq\frac{D}{\sqrt{Nh^2+Nv^2}}-2db \quad (16)$$

and the short distance Ds (mm) of the electron passing aperture is expressed by the following formula (17):

$$Ds\leq\frac{D}{3\cdot\sqrt{Nh^2+Nv^2}}-2db \quad (17)$$

the following formula (18) is established:

$$2170\cdot Lkg^3-120\cdot Lkg^2+2.08\cdot Lkg\leqq Ds\leqq 21400\cdot Lkg^3-815\cdot Lkg^2+9.92\cdot Lkg \quad (18)$$

Although the above-mentioned electron sources may be formed of any one of an MIM, a surface conduction type electron source, a diamond film, a graphite film, carbon nanotubes and the like, the carbon nanotubes are particularly preferable. Further, the strip-like electrode elements which constitute the control electrodes may be formed of plate-like control electrodes, and projecting leg portions which are formed together with electron passing apertures by etching may be provided on the back substrate side of the plate-like control electrodes, and these leg portions may be arranged individually for respective groups of pixels. Then, it is preferable to define the distance Lkg(mm) between the electron sources and the strip-like electrode elements based on the projection quantity of the leg portions at the back substrate side.

Due to the above-mentioned respective constitutions of the present invention, the aperture diameter or the short diameter of the electron passing apertures can be made as small as possible; and, hence, it is possible to obtain an image display device which can obtain a high current density at low voltage.

Here, it is needless to say that the present invention is not limited to the above-mentioned constitutions and the constitutions of embodiments to be described later, and various modifications are conceivable without departing from the technical concept of the present invention.

DESCRIPTION OF THE PREFERRED EMBODIMENTS

Figure 1:
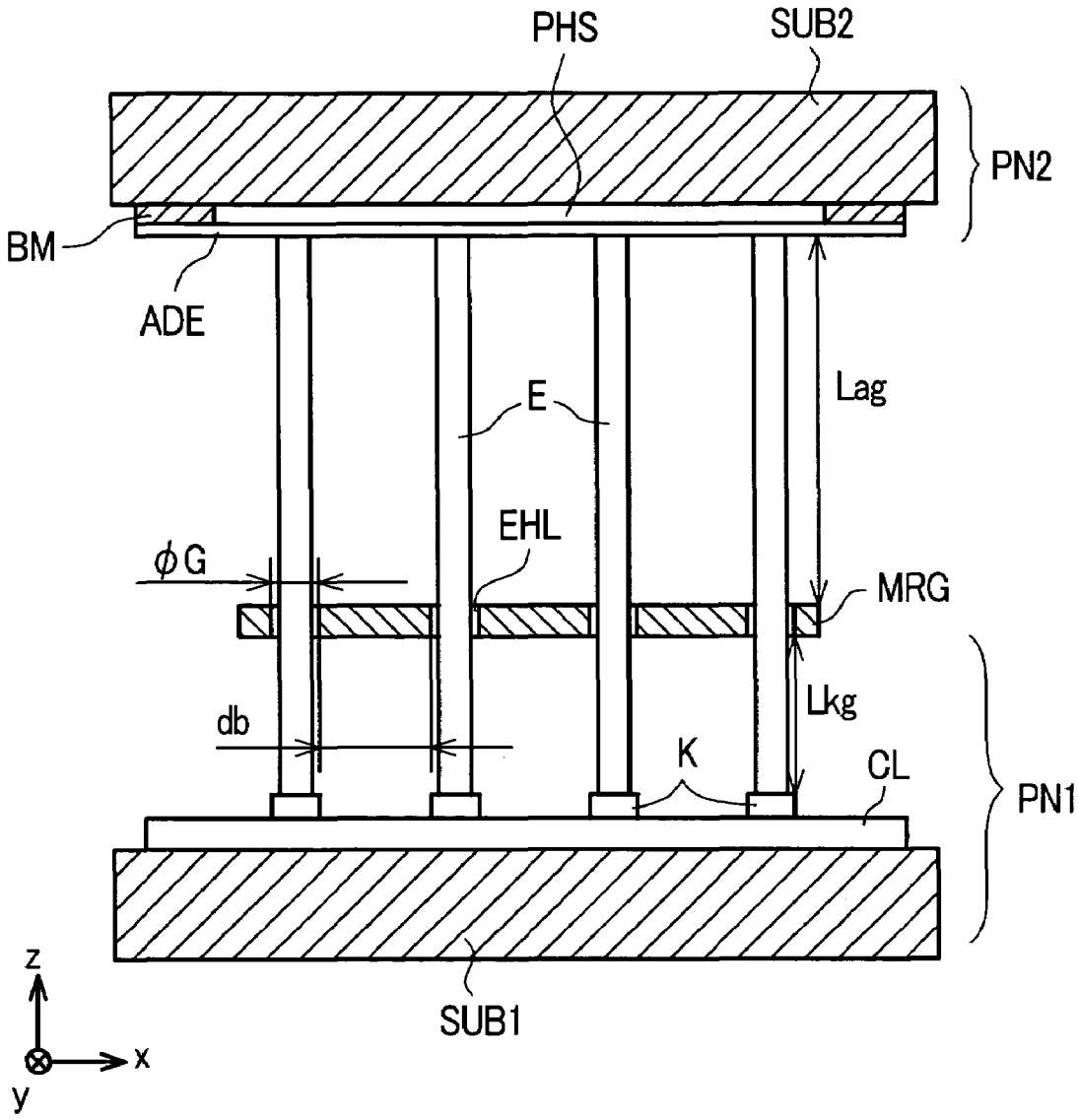
FIG. 1 is a cross-sectional view showing the vicinity of one pixel, which schematically illustrates one embodiment of an image display device according to the present invention.

Hereinafter, an embodiment of the present invention will be explained in detail in conjunction with the drawings. FIG. 1 shows the vicinity of one pixel for schematically illustrating one embodiment of the image display device according to the present invention. In the drawing, SUB1 indicates a back substrate which is made of an insulating material, preferably of glass or the like; and, it constitutes a basic element of the back panel PN1, wherein a plurality of cathode lines CL, having electron sources K, which extend in a first direction x (here, horizontal direction) and are arranged in parallel in a second direction y (here, vertical direction), are formed on an inner surface thereof. Further, on the back panel PN1, a plurality of control electrodes are formed, which intersect the cathode lines CL in a non-contact manner and extend in the y direction and are arranged in parallel in the x direction, thus constituting pixels at the intersections thereof. The plurality of control electrodes are formed by arranging thereon a plurality of mutually independent strip-like electrode elements MRG, each of which includes a plurality of electron passing apertures EHL, which allow electrons E from the electron sources K to pass therethrough to the face panel PN2 side.

On the other hand, the face panel PN2 is laminated to the back panel PN1 while maintaining a given distance therebetween in the z direction. The face panel PN2 includes fluorescent materials PHS and anodes ADE, which are defined by a black matrix BM that is formed on an inner surface of the face substrate SUB2, which is made of a transparent insulating material, such as glass or the like. The space defined between the back panel PN1 and the face panel PN2 is evacuated and sealed.

A given potential difference is provided among the cathode lines CL, the strip-like electrode elements MRG and the anodes ADE. Accordingly, electrons E from the electron sources K formed on the cathode lines CL pass through circular electron passing apertures EHL formed in the strip-like electrode elements MRG, which constitute the control electrodes, and are directed to the anodes ADE, and they excite the fluorescent materials PHS so as to emit light having a given wavelength. These pixels are arranged two-dimensionally so that a display region is formed on the front panel PN2 on which images are displayed.

In FIG. 1, assume a diagonal size of a display region formed on the face panel PN2 as D(mm), the number of pixels arranged in the x direction as Nh, the number of pixels arranged in the y direction as Nv, the distance between the circular electron passing apertures EHL formed in the strip-like electrode elements MRG as db(mm), the distance between the electron sources K and the strip-like electrode element MRG as Lkg(mm), and the size of the diameter of the electron passing apertures EHL as $\phi$G(mm). Here, Lag (mm) is the distance between the anodes ADE and the strip-like electrode elements MRG.

Figure 2:
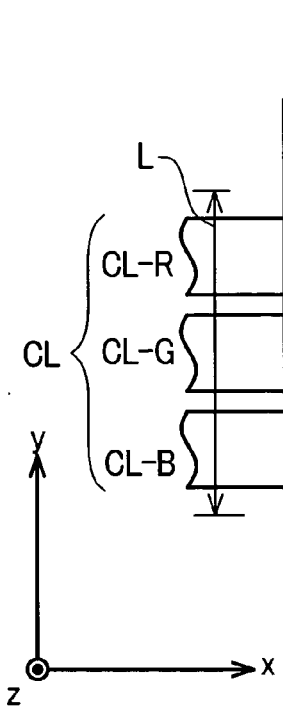
FIG. 2(*a*) is a plan view and FIG. 2(*b*) is a sectional view taken along line A–A' in FIG. 2(*a*), showing the vicinity of one pixel of the image display device of FIG. 1.
Figure 2:
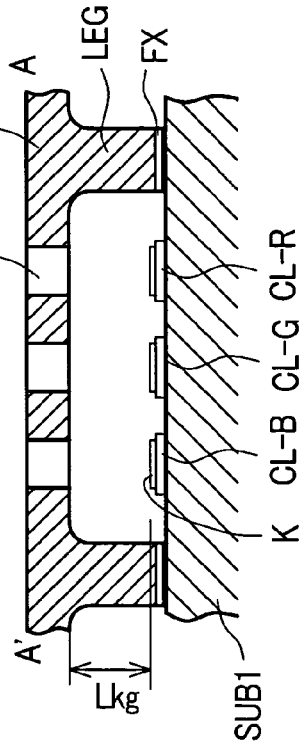

FIG. 2(*a*) and FIG. 2(*b*) are specific views of the structural arrangement in the vicinity of one pixel of the image display device shown in FIG. 1, in which only the constitution of the back substrate in shown. FIG. 2(*a*) is a plan view, and FIG. 2(*b*) is a cross-sectional view taken along a line A–A' in FIG. 2(*a*). The cathode lines CL, which are arranged on the back substrate SUB1, are constituted of cathode lines CL-R, CL-G and CL-B which correspond to the three colors of red (R), green (G) and blue (B) in this embodiment. One pixel shown in FIG. 1 corresponds to one sub pixel of the color pixel in FIG. 2(*a*) and FIG. 2(*b*). When the specification simply refers to a "pixel", this implies that the pixels and the sub pixels are not particularly distinguished from each other. The strip-like electrode element MRG, which intersects these cathode lines, is used in common with respect to the cathode lines CL-R, CL-G and CL-B, and one or more electron passing apertures EHL are formed in the x direction corresponding to the electron source K provided to each cathode line CL-R, CL-G or CL-B. Here, an explanation will be given with respect to a case in which four electron passing apertures EHL are formed. In FIG. 2(*a*) and FIG. 2(*b*), although the electron sources K are arranged corresponding to individual electron passing apertures EHL of the strip-like electrode element MRG, this embodiment is not limited to such a constitution, and there may be a case in which an electron source K is arranged in common with respect to plural electron passing apertures EHL of the strip-like electrode element MRG corresponding to each cathode line.

The strip-like electrode element MRG is a web formed of an iron-based thin plate, wherein a leg portion LEG is formed together with the electron passing apertures EHL by etching. The leg portion LEG is projected to the back substrate SUB1 side and is fixed to the back substrate SUB1 by an adhesive agent FX. Here, the leg portion LEG may be directly brought into contact with the back substrate SUB1 without using the adhesive agent FX. In this case, the leg portions LEG are held at a given position by being pushed to the back substrate SUB1 by means of distance holding members (not shown in the drawing) which are interposed between the strip-like electrode elements MRG and the face substrate. Also, in the case in which the adhesive agent FX is used, the leg portions LEG may be pushed to the back substrate SUB1 by means of distance holding members in the same manner. The dimensions of the respective parts shown in FIG. 2(*a*) and FIG. 2(*b*) correspond to those dimensions as designated in FIG. 1. Here, L indicates the size in the y direction of one color pixel, and the size of a sub pixel in the y direction is L/3.

In such an arrangement, assuming a diagonal screen size of a display region formed on the face substrate SUB2 as D(mm), the number of pixels (sub pixels in this case) arranged in the x direction as Nh, the number of pixels (sub pixels in this case) arranged in the y direction as Nv, the distance between the electron passing apertures EHL formed in the strip-like electrode elements MRG which constitute the control electrodes as db(mm), the distance between the electron sources K and the strip-like electrode element MRG as Lkg(mm), and the diameter of the electron passing apertures EHL as ϕG(mm), provided that the diameter size of the electron passing apertures EHL as ϕG(mm) is expressed by a following equation (19):

$$\frac{D}{3\cdot\sqrt{Nh^2+Nv^2}}-2db > (-0.23\cdot\ln(db)+0.49)\cdot Lkg+0.02\cdot\ln(db)+0.125 \tag{19}$$

the following relationship (20) is established:

$$(0.46\cdot\ln(db)+2.5)\cdot Lkg+0.006\cdot\ln(db)+0.04\leqq\phi G\leqq(-0.41\cdot\ln(db)-0.68)\cdot Lkg+0.014\cdot\ln(db)+0.145 \tag{20}$$

Due to such a constitution, the current quantity per one pixel (sub pixel) is increas d, and it is possible to achieve a relative reduction of the driving voltage. Accordingly, an image display of high luminance can be obtained, while a reduction of the driving voltage facilitates the constitution of the driving circuit, thus producing a reduction of the cost and an enhancement of the reliability.

Further, as another embodiment of the present invention, when the diameter of the electron passing apertures EHL as ϕG(mm) is expressed by the following equation (21), $$\frac{D}{3\cdot\sqrt{Nh^2+Nv^2}}-2db \leq (-0.23\cdot\ln(db)+0.49)\cdot Lkg+0.02\cdot\ln(db)+0.125 \tag{21}$$

the following relationship (22) is established, $$\phi G\min \leq \phi G \leq \frac{D}{3\cdot\sqrt{Nh^2+Nv^2}}-2db \tag{22}$$

wherein, the value ϕGmin is set to either one of $$\frac{3}{4}\left(\frac{D}{3\cdot\sqrt{Nh^2+Nv^2}}-2db\right) \tag{23}$$

and $$(0.46\cdot\ln(db)+2.5)\cdot Lkg+0.006\cdot\ln(db)+0.04 \tag{24}$$

Due to such a constitution, the current quantity per one pixel (sub pixel) is increased, and it is possible to achieve a relative reduction of the driving voltage. Accordingly, an image display of high luminance can be obtained, while a reduction of the driving voltage facilitates the constitution of the driving circuit, thus producing a reduction of cost and an enhancement of the reliability.

Figure 3:
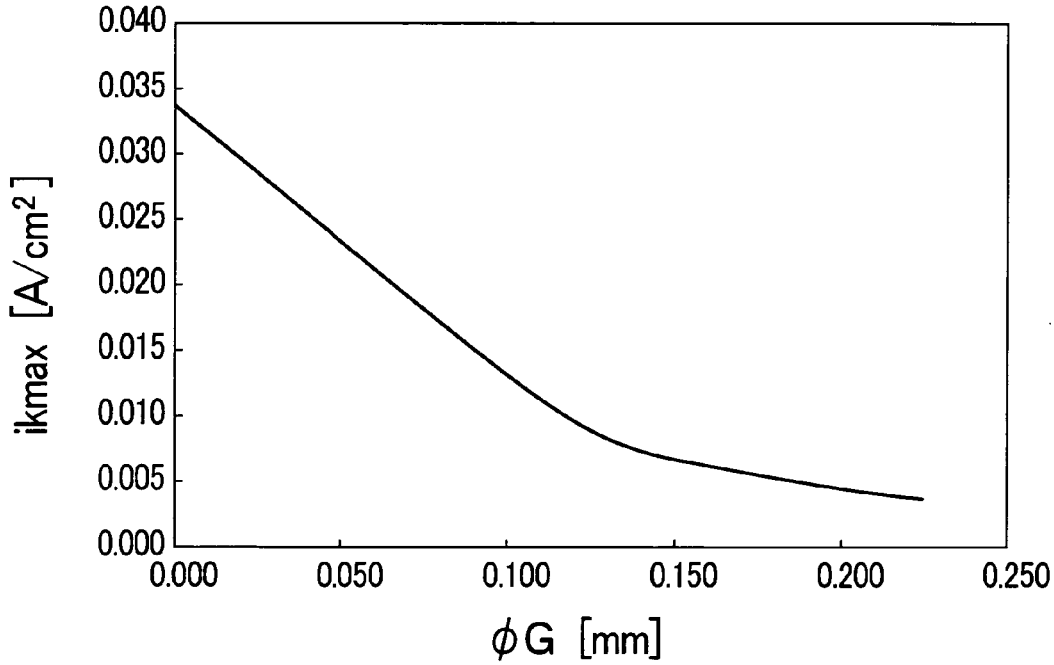
FIG. 3 is a graph showing a result obtained by analyzing the maximum current density for an electron passing aperture diameter of a strip-like electrode element using an electron beam locus simulator under a condition that the maximum values of scanning pulse voltage and signal voltage are 40 V (the maximum voltage difference between the strip-like electrode element and the cathode line is 80 V)

Next, the driving of the image display device according to the present invention will be explained. As a driving method, in general, scanning pulses are inputted to the strip-like electrode element MRG side and signals for providing a display are supplied to the cathode line CL side. As a premise of such driving, in view of the characteristics, the cost and the like of the driving circuit, it is preferable that the maximum values of the scanning pulse voltage and the signal voltage are made as extremely small as possible. To meet this premise, the maximum current density ikmax generated by the cathode with respect to the electron passing aperture diameter (control electrode aperture diameter) ϕG of the strip-like electrode element MRG, under the condition that, for example, the maximum values of the scanning pulse voltage and the signal voltage are 40 V (the maximum voltage difference between the strip-like electrode element MRG and the cathode line CL (CL-R, CL-G, CL-B) is 80 V), is analyzed using an electron beam locus simulator, and the result of such an analysis is shown in FIG. 3.

The analysis conditions, other than the electron passing aperture diameter ϕG, are set such that the distance Lag between the anode ADE and the strip-like electrode element MRG is set to Lag=3.0 mm, the distance Lkg between the electron source K and the strip-like electrode element MRG is set to Lkg=0.03 mm, the anode voltage is 10 kV, and the voltage applied to the strip-like electrode element MRG is set to 80 V. As can be understood from FIG. 3, the smaller the apertur diamet r of the electron passing apertures, the more the current density is increased. Accordingly, to increase the current quantity by reducing the drive voltage, it has been considered conventionally that the aperture diameter of the electron passing apertures formed in the strip-like electrode element MRG should be made small.

Figure 4:
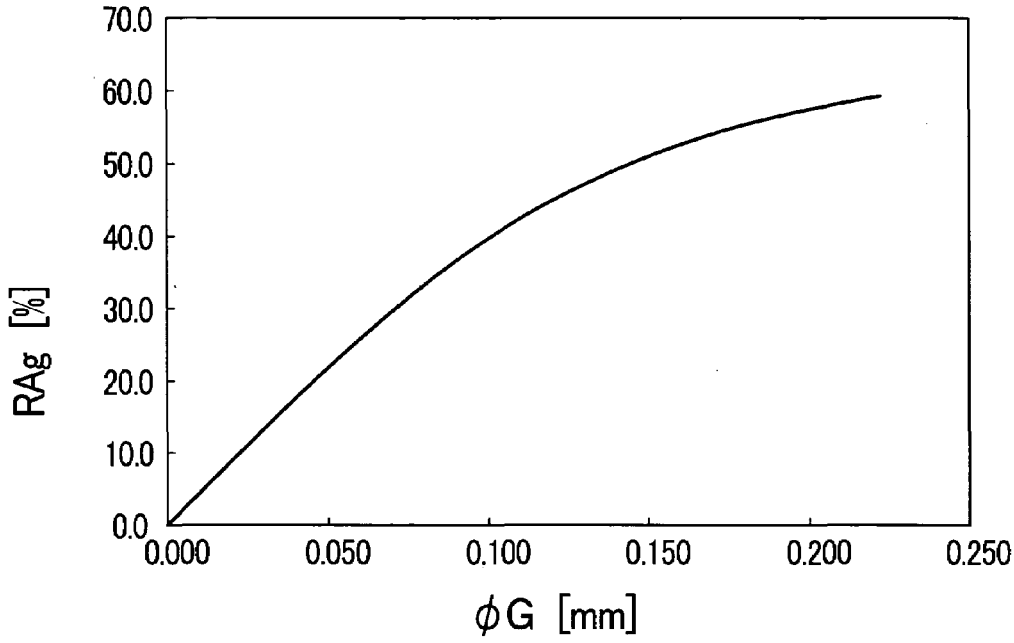
FIG. 4 is a graph showing the relationship of an aperture ratio of the strip-like electrode element with respect to the electron passing aperture diameter (control electrode aperture ratio) when a distance between electron passing apertures of the strip-like electrode element is set to 0.05 mm.
Figure 5:
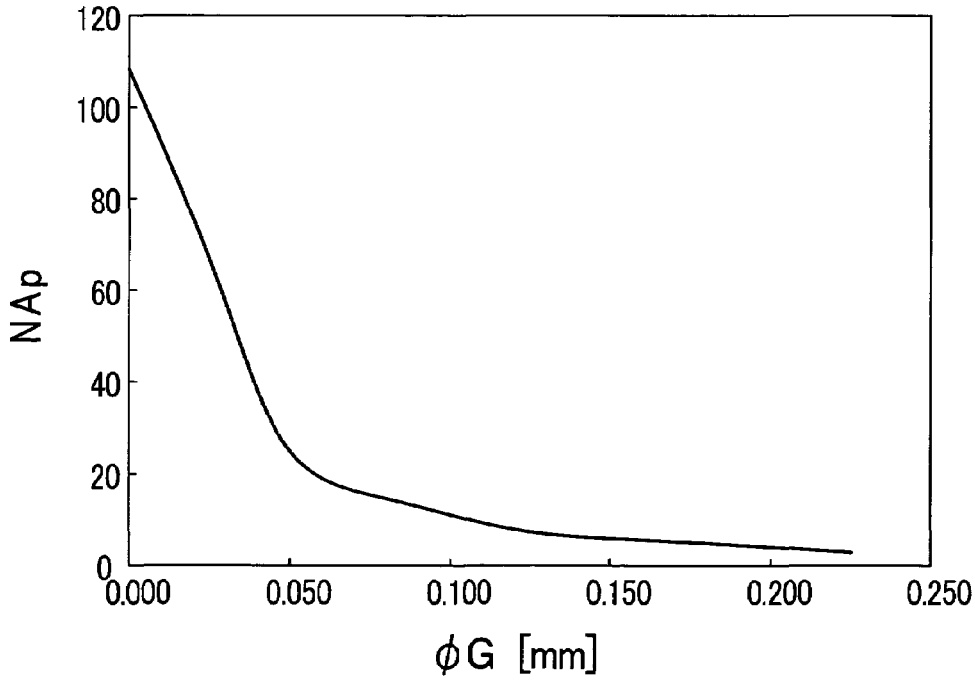
FIG. 5 is a graph showing the number of electron passing apertures per sub pixel in a WVGA having a nominal 42 inches in the diagonal direction of a screen (size of one color pixel being 1.08 mm×1.08 mm, size of one sub pixel being 1.08 mm×0.36 mm) when a distance of 0.1 mm is formed between neighboring pixels.

FIG. 4 is a graph showing the relationship of the aperture ratio RAg of the strip-like electrode element with respect to the electron passing aperture diameter ϕG (control electrode aperture ratio) when the distance between electron passing apertures of the strip-like electrode element is set to 0.05 mm. As shown in FIG. 4, along with the increase of the aperture diameter of the electron passing apertures, the numerical aperture of the control electrode is increased. Further, due to such a constitution, when the diagonal size of the screen and the number of pixels are determined, it is possible to determine the number of electron passing apertures of the strip-like electrode element per pixel. By taking the dielectric strength characteristics between neighboring pixels at the time of driving into consideration, FIG. 5 shows the relationship between the aperture diameter ϕG of the control electrode and the number Nap of electron passing apertures formed on the control electrode per sub pixel in a WVGA having a nominal 42 inches in the diagonal direction of a screen (size of one color pixel being 1.08 mm×1.08 mm, size of one sub pixel being 1.08 mm×0.36 mm) when a distance of 0.1 mm is formed between neighboring pixels.

Figure 6:
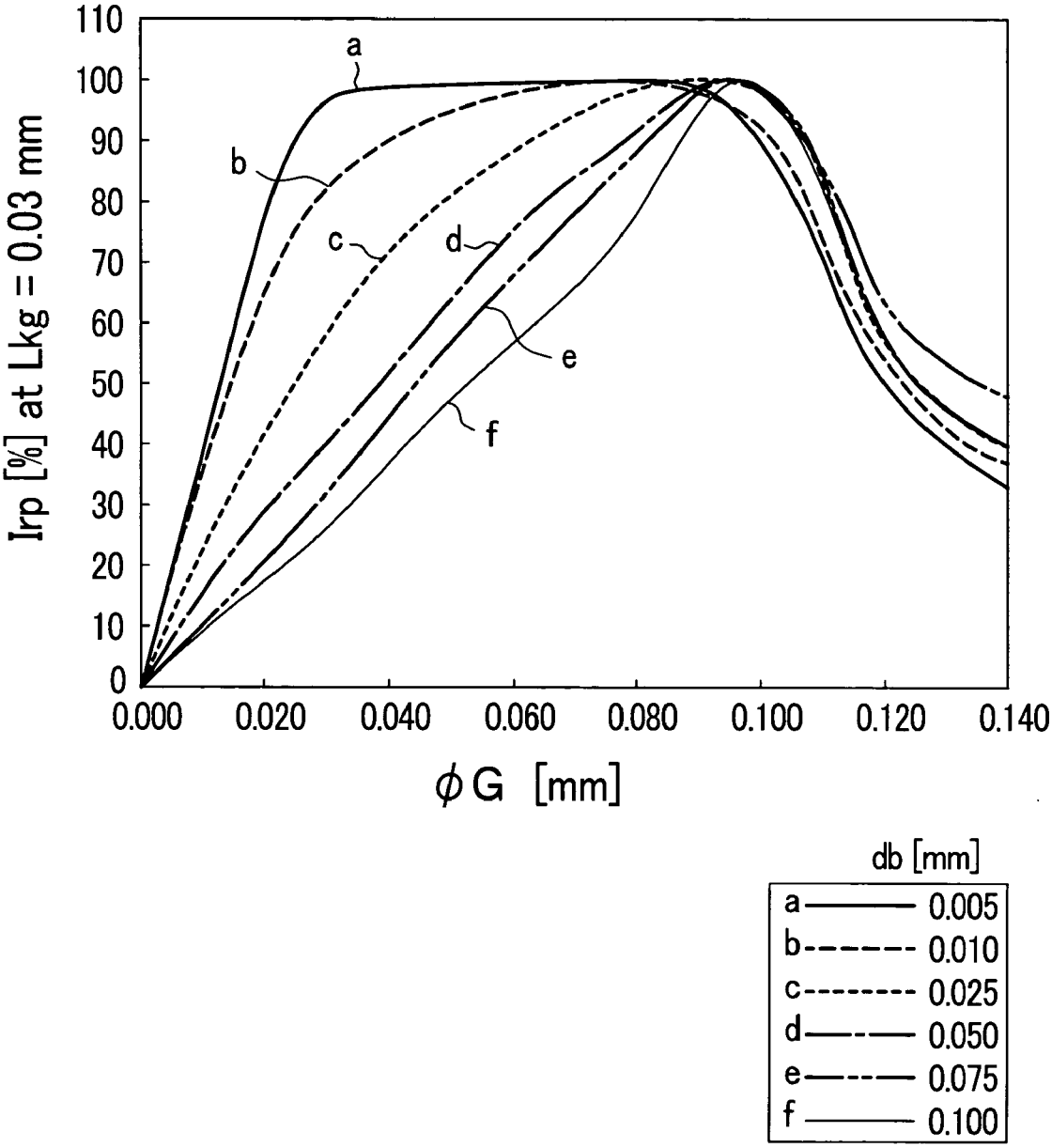
FIG. 6 is a graph showing a result of obtaining a current value (relative value) per one sub pixel when the distance of strip-like electrode elements which constitute control electrodes with respect to an electron source is set to 0.03 mm.
Figure 7:
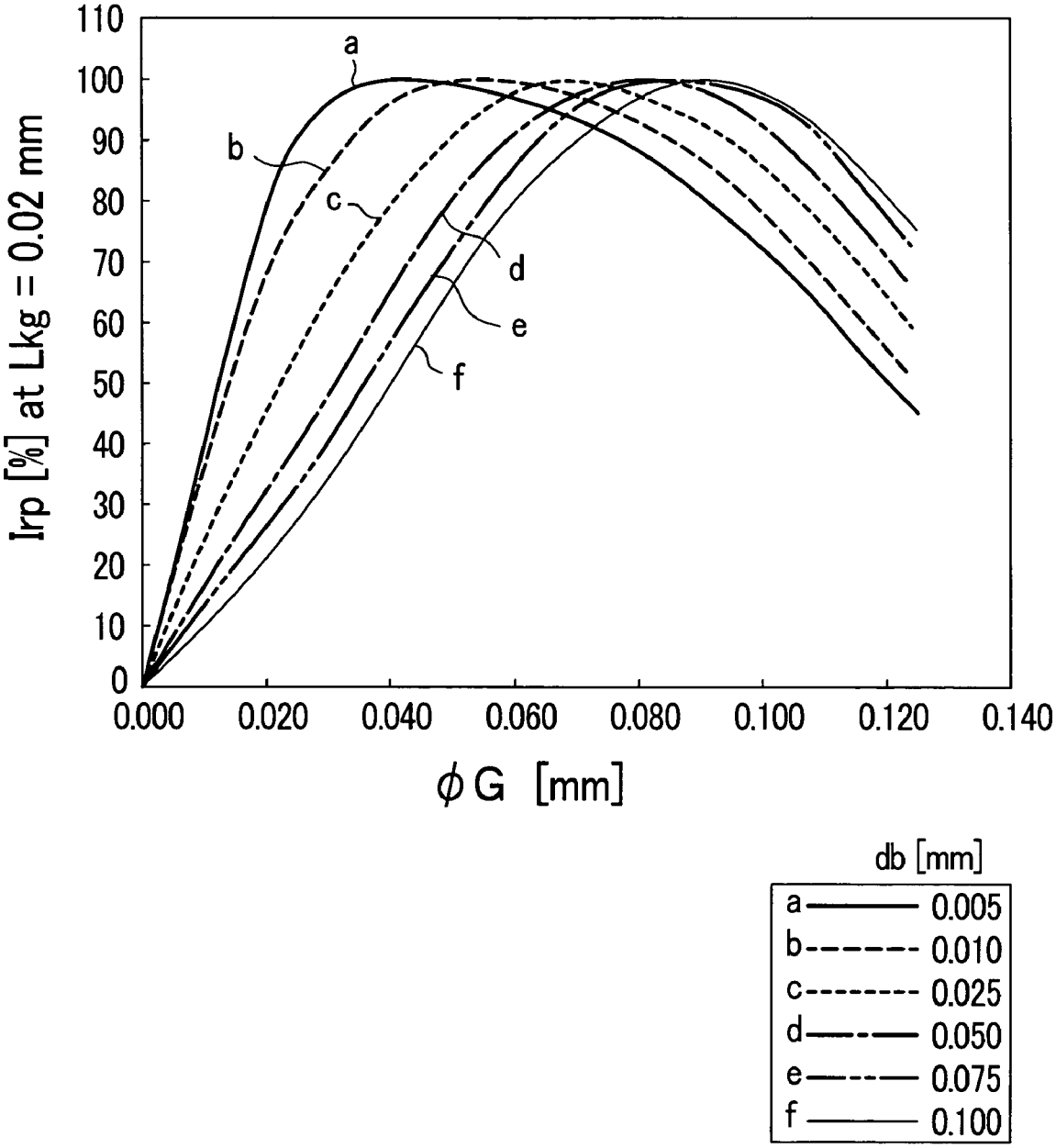
FIG. 7 is a graph showing a result of obtaining a current value (relative value) per one sub pixel when the distance of strip-like electrode elements which constitute control electrodes with respect to an electron source is set to 0.02 mm.
Figure 8:
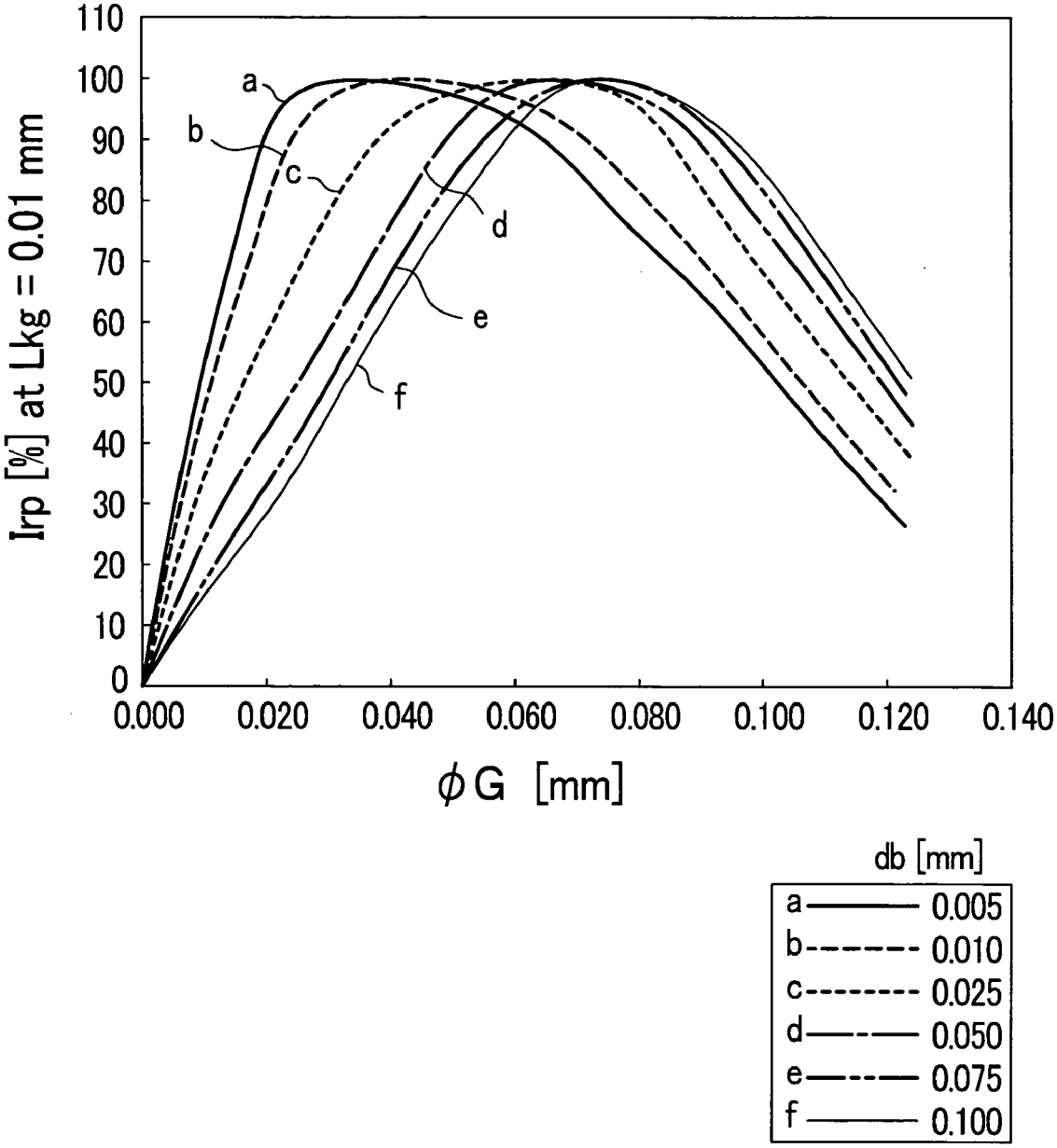
FIG. 8 is a graph showing a result of obtaining a current value (relative value) per one sub pixel when the distance of strip-like electrode elements which constitute control electrodes with respect to an electron source is set to 0.01 mm.
Figure 9:
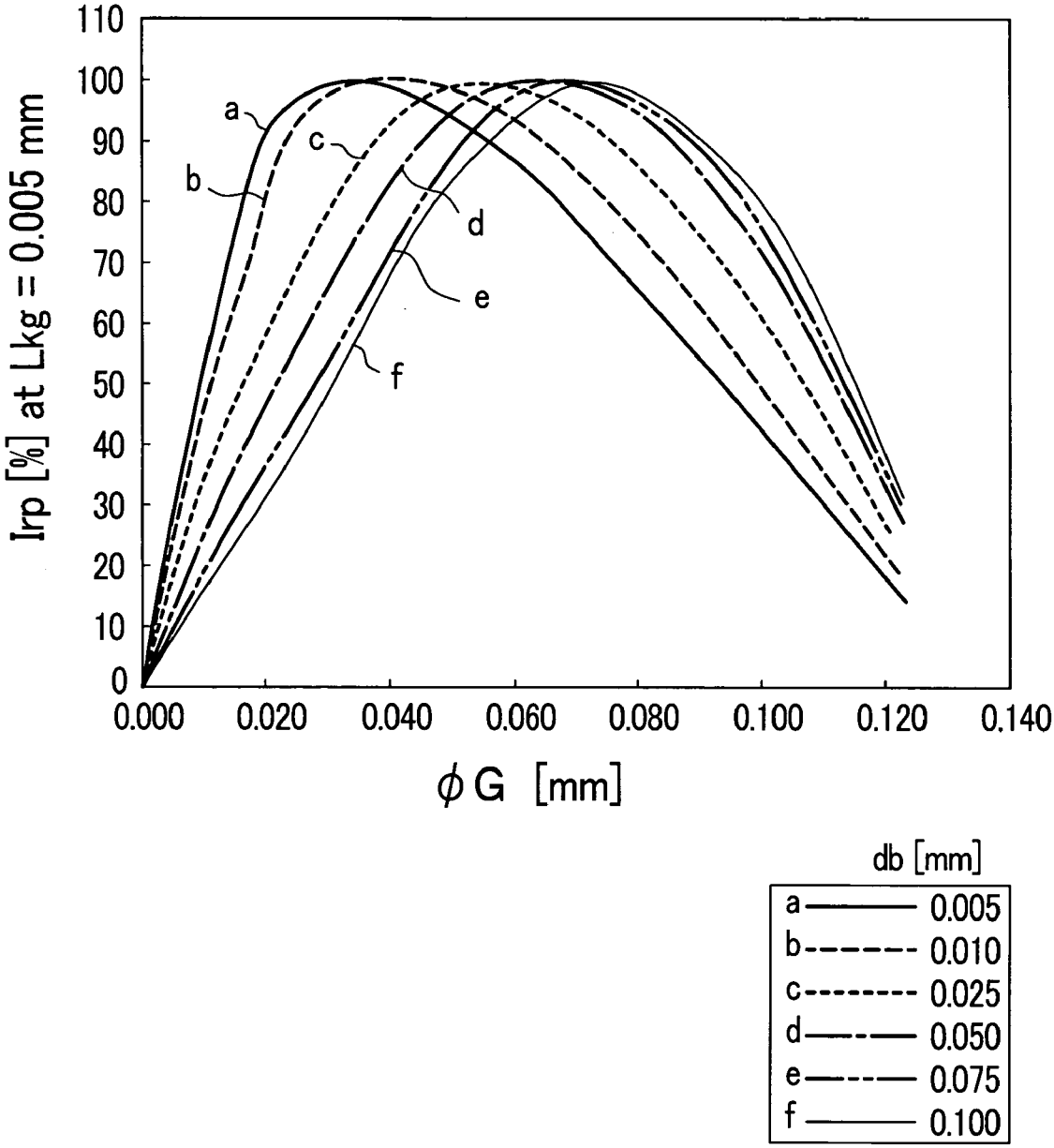
FIG. 9 is a graph showing a result of obtaining a current value (relative value) per one sub pixel when the distance of strip-like electrode elements which constitute control electrodes with respect to an electron source is set to 0.005 mm.

Based on the above-mentioned explanation, FIG. 6 to FIG. 9 show a result of obtaining a current value (relative value) lrp per one sub pixel with respect to the aperture diameter ϕG of the electron passing apertures for every distance Lkg of strip-lik electrode elements MTG which constitute control electrode with respect to the electron source K, using the distance db between the electron passing apertures of the strip-like electrode element MRG as a parameter. FIG. 6 shows a case in which the distance Lkg is set as Lkg=0.03 mm; FIG. 7 shows a case in which the distance Lkg is set as Lkg=0.02 mm; FIG. 8 shows a case in which the distance Lkg is set as Lkg=0.01 mm; and FIG. 9 shows a case in which the distance Lkg is set as Lkg=0.005 mm. In the respective drawings, the curve "a" represents a case in which the distance db is set as db=0.005 mm, the curve "b" represents a case in which the distance db is set as db=0.010 mm, the curve "c" represents a case in which the distance db is set as db=0.025 mm, the curve "d" represents a case in which the distance db is set as db=0.050 mm, the curve "e" represents a case in which the distance db is set as db=0.075 mm, and the curve "f" represents a case in which the distance db is set as db=0.100 mm.

Figure 10:
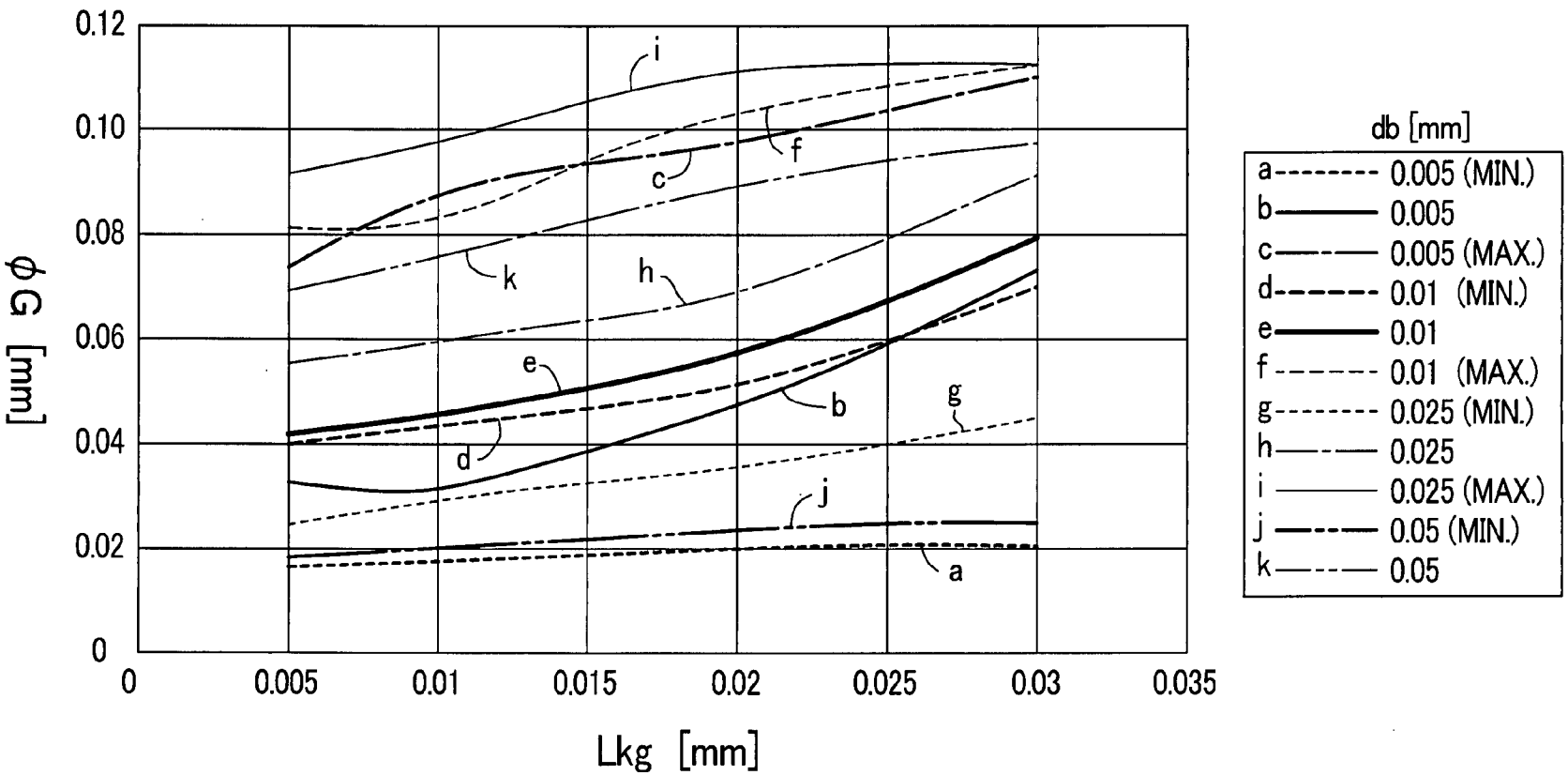
FIG. 10 is a graph in which the optimum aperture diameter by which the maximum current is obtained for the distance of the strip-like electrode elements is plotted with respect to the electron source and the minimum and the maximum aperture diameters with which a current of equal to or more than 75% of the maximum current at the optimum aperture diameter is obtained.

Based on FIG. 6 to FIG. 9, in FIG. 10, the optimum aperture diameter by which the maximum current is obtained for the distance Lkg of the strip-like electrode elements MRG with respect to the electron source K and the minimum and maximum aperture diameters with which a current of equal to or more than 75% of the maximum current is obtained at the optimum aperture diameter using the distance db between the electron passing apertures of the strip-like electrode elements MRG as a parameter, are plotted. "Range in which the current which is equal to or more than 75% of the maximum current at the optimum aperture diameter is obtained" is a range in which the maximum current is obtained structurally with respect to the electron source-strip-like electrode element distance Lkg. That is, when the current value per sub pixel becomes smaller than 75% of the maximum current in the direction in which the aperture diameter becomes smaller, the numerical aperture of the control electrode is decreased; and, hence, it is difficult for the electrons to pass through the apertures of the control electrode and, at the same time, the rate at which the electrons impinge on the bridge portion of the control electrode is increased. Thus, the grid loss is increased, whereby the utilization effect of electrons is lowered. Further, when the current value per sub pixel becomes smaller than 75% of the maximum current in the direction that the aperture diameter becomes larger, the current density is lowered; and, hence, driving at a low voltage becomes difficult. With respect to curves "a" to "k" in FIG. 10, the curve "a" represents a case in which the distance db is set as db=0.005 mm (minimum aperture diameter), the curve "b" represents a case in which the distance db is set as db=0.005 mm (optimum aperture diameter), and the curve "c" represents a case in which the distance db is set as db=0.005 mm (maximum aperture diameter). Further, the curve "d" represents a case in which the distance db is set as db=0.010 mm (minimum aperture diameter), the curve "e" represents a case in which the distance db is set as db=0.010 mm (optimum aperture diameter), and the curve "f" represents a case in which the distance db is set as db=0.010 mm (maximum aperture diameter). In the same manner, the curve "g" represents a case in which the distance db is set as db=0.025 mm (minimum aperture diameter), the curve "h" represents a case in which the distance db is set as db=0.025 mm (optimum aperture diameter), the curve "i" represents a case in which the distance db is set as db=0.025 mm (maximum aperture diameter), the curve "j" represents a case in which the distance db is set as db=0.050 mm (minimum aperture diameter), and the curve "k" represents a case in which the distance db is set as db=0.050 mm (optimum aperture diameter).

Since each curve shown in FIG. 10 is a monotone increasing function, the electron passing aperture diameter ϕC is regarded as a first-order function of the electron source-strip-like electrode element distance Lkg. By treating the electron passing aperture diameter ϕG as a linear function and applying the least square method to the linear function, the electron passing aperture diameter ϕG can be expressed by a following equation.

$$\phi G = C_1 \cdot Lkg + C_2$$

Figure 11:
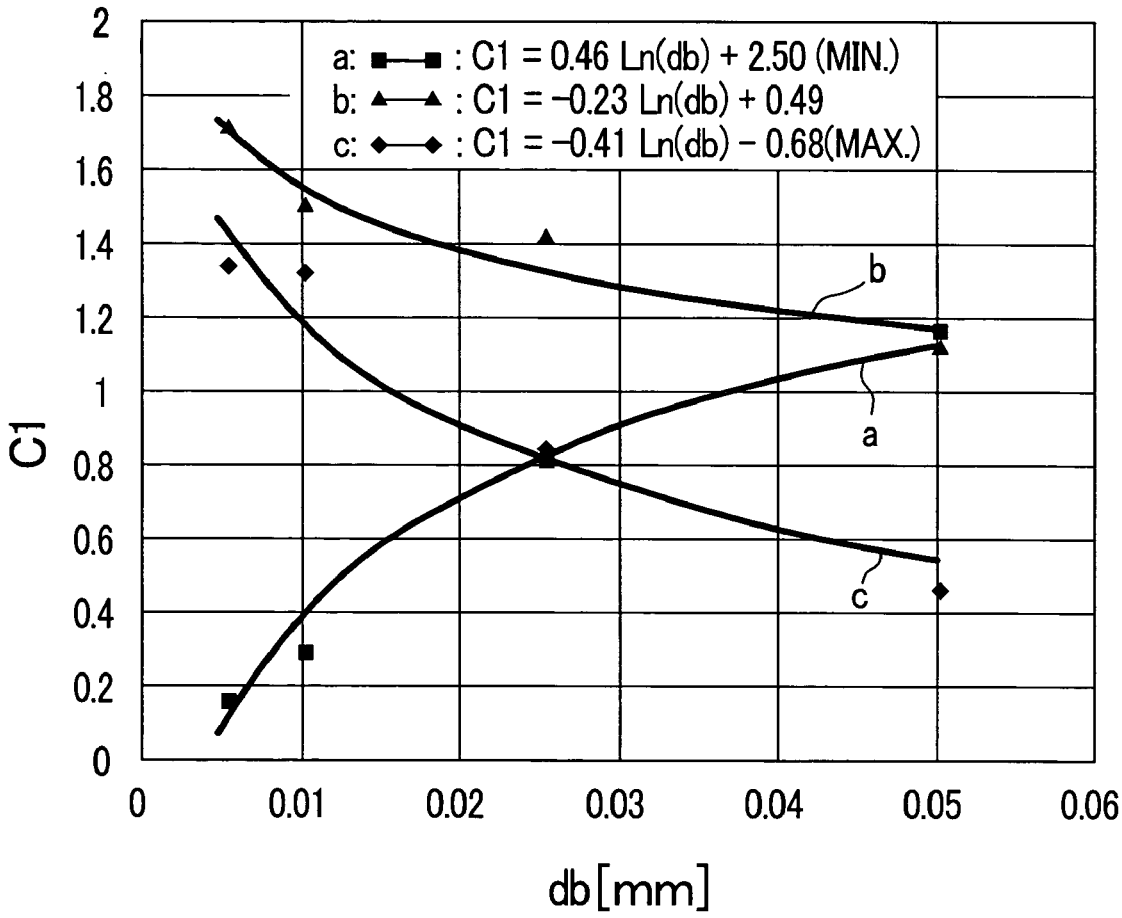
FIG. 11 is a graph of coefficients which define the aperture diameters (minimum, optimum and maximum aperture diameters) of the electron passing apertures when a least square method is applied to respective curves shown in FIG. 10.
Figure 12:
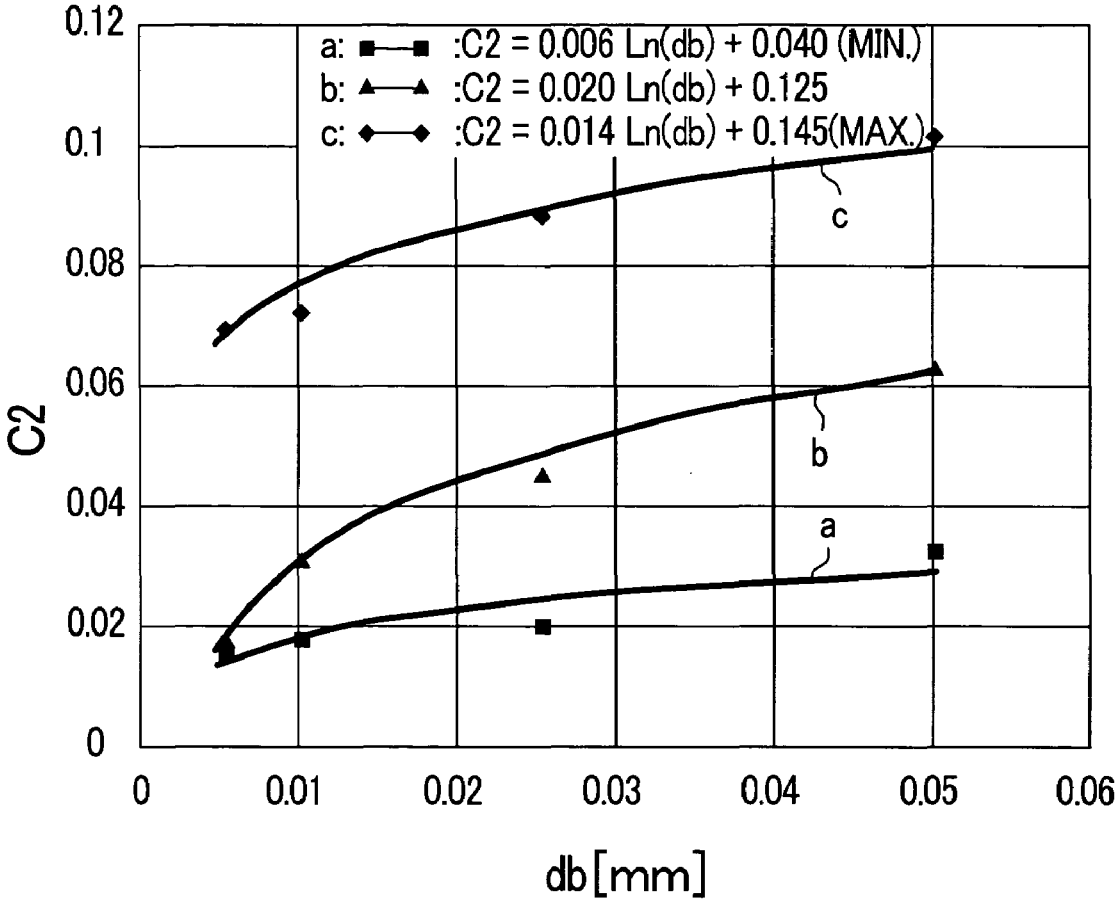
FIG. 12 is a graph of other coefficients which define the aperture diameters (minimum, optimum and maximum aperture diameters) of the electron passing apertures when a least square method is applied to respective curves shown in FIG. 10.

Further, the coefficients $C_1$, $C_2$ are functions of the electron passing aperture distance db, and a result shown in FIG. 11 and FIG. 12 is obtained by plotting the coefficients $C_1$, $C_2$ with respect to the electron passing aperture distance db. As can be understood from graph shapes shown in FIG. 11 and FIG. 12, the relationship between the coefficients $C_1$, $C_2$ and the electron passing aperture distance db is determined using a least square method based on a logarithmic function. FIG. 11 corresponds to the coefficients $C_1$, while FIG. 12 corresponds to the coefficients $C_2$.

From the above, the optimum aperture diameter of the electron passing apertures formed in the strip-like electrode element by which the maximum current is obtained and the minimum and the maximum aperture diameters with which a current of equal to or more than 75% of the maximum current value is obtained become as follows.

optimum aperture diameter: $(-0.23 \cdot \ln(db)+0.49) \cdot Lkg+0.02 \cdot \ln(db)+0.125$ minimum aperture diameter: $(0.46 \cdot \ln(db)+2.5) \cdot Lkg+0.006 \cdot \ln(db)+0.04$ maximum aperture diameter: $(-0.41 \cdot \ln(db)-0.68) \cdot Lkg+0.014 \cdot \ln(db)+0.145$ On the other hand, assuming a diagonal screen size of D(mm), the number of pixels in the x direction as Nh and the number of pixels in the y direction as Nv, the size L of one side of a single pixel is given by a following formula (25). Here, the aspect ratio of the single pixel is set to 1:1

$$L = \frac{D}{\sqrt{Nh^2 + Nv^2}} \tag{25}$$

Since the short-side (y direction) size Lp of the sub pixel is ⅓ of the length L, the size Lp is expressed the a following formula (26).

$$L_p = \frac{D}{3 \cdot \sqrt{Nh^2 + Nv^2}} \tag{26}$$

Here, the maximum value ϕGmax of the aperture diameter of the electron passing aperture of the strip-like electrode element MRG is defined by the bridge, that is, the distance db between the short-side size Lp of the sub pixel and the electron passing aperture. In manufacturing the strip-like electrode element, it is necessary to provide bridges at at least both sides of the electron passing aperture, and, hence, the maximum value ϕGmax is expressed by the formula (27).

$$\phi G\max = L_p - 2db = \frac{D}{3\cdot\sqrt{Nh^2+Nv^2}} - 2db \tag{27}$$

In a range in which the aperture diameter ϕGmax assumes the aperture diameter ϕGmax≦optimum aperture diameter, the current at the aperture diameter ϕGmax becomes the obtainable maximum current. Accordingly, the aperture diameter ϕGmax falls within a range expressed by the following formula (28).

$$\phi G\max = \frac{D}{3\cdot\sqrt{Nh^2+Nv^2}} - 2db \le (-0.23\cdot\ln(db)+0.49)\cdot Lkg + 0.02\cdot\ln(db) + 0.125 \tag{28}$$

Accordingly, in this embodiment, an upper limit of the diameter ϕG is given by the following formula (29).

$$\phi G \le \frac{D}{3\cdot\sqrt{Nh^2+Nv^2}} - 2db \tag{29}$$

Further, as shown in FIG. 6 to FIG. 9, the change of the current value, in a range in which the aperture diameter is smaller than the optimum value, is expressed by curves which are bulged upwardly; and, hence, provided that the following formula (30) is established, it is surely possible to obtain a current value which is equal to or more than 75% of the maximum value.

$$\frac{3}{4}\left(\frac{D}{3\cdot\sqrt{Nh^2+Nv^2}} - 2db\right) \le \phi G \tag{30}$$

Accordingly, the minimum value assumes the smaller value out of the value expressed by the following formula (31) and $$\frac{3}{4}\left(\frac{D}{3\cdot\sqrt{Nh^2+Nv^2}} - 2db\right) \tag{31}$$

the value expressed by the following formula (32).

$$(0.46\cdot\ln(db)+2.5)\cdot Lkg+0.006\cdot\ln(db)+0.04 \tag{32}$$

To summarize the above, in selecting the current value which is equal to or more than 75% of the maximum current value, assuming a diagonal screen size as D(mm), the number of the pixels which are arranged in the x direction as Nh, the number of the pixels which are arranged in the y direction as Nv, the distance between the electron passing apertures formed in the strip-like electrode elements MRG which constitute the control electrodes as db(mm), and an aperture diameter of the electron passing apertures as ϕG(mm), provided that a following formula (33) is satisfied, $$\frac{D}{3\cdot\sqrt{Nh^2+Nv^2}} - 2db > (-0.23\cdot\ln(db)+0.49)\cdot Lkg + 0.02\cdot\ln(db) + 0.125 \tag{33}$$

the following formula (34) is established, $$(0.46\cdot\ln(db)+2.5)\cdot Lkg+0.006\cdot\ln(db)+0.04 \le \phi G \le (-0.41\cdot\ln(db)-0.68)\cdot Lkg+0.014\cdot\ln(db)+0.145 \tag{34}$$

and, provided that the following formula (35) is satisfied, $$\frac{D}{3\cdot\sqrt{Nh^2+Nv^2}} - 2db \le (-0.23\cdot\ln(db)+0.49)\cdot Lkg + 0.02\cdot\ln(db) + 0.125 \tag{35}$$

the following formula (36) is established, $$\phi G\min \le \phi G \le \frac{D}{3\cdot\sqrt{Nh^2+Nv^2}} - 2db \tag{36}$$

and the minimum value ϕGmin assumes the smaller value out of a value expressed by the following formula (37)

$$\frac{3}{4}\left(\frac{D}{3\cdot\sqrt{Nh^2+Nv^2}} - 2db\right) \tag{37}$$

and a value expressed by the following formula (38).

$$(0.46\cdot\ln(db)+2.5)\cdot Lkg+0.006\cdot\ln(db)+0.04 \tag{38}$$

Figure 13:
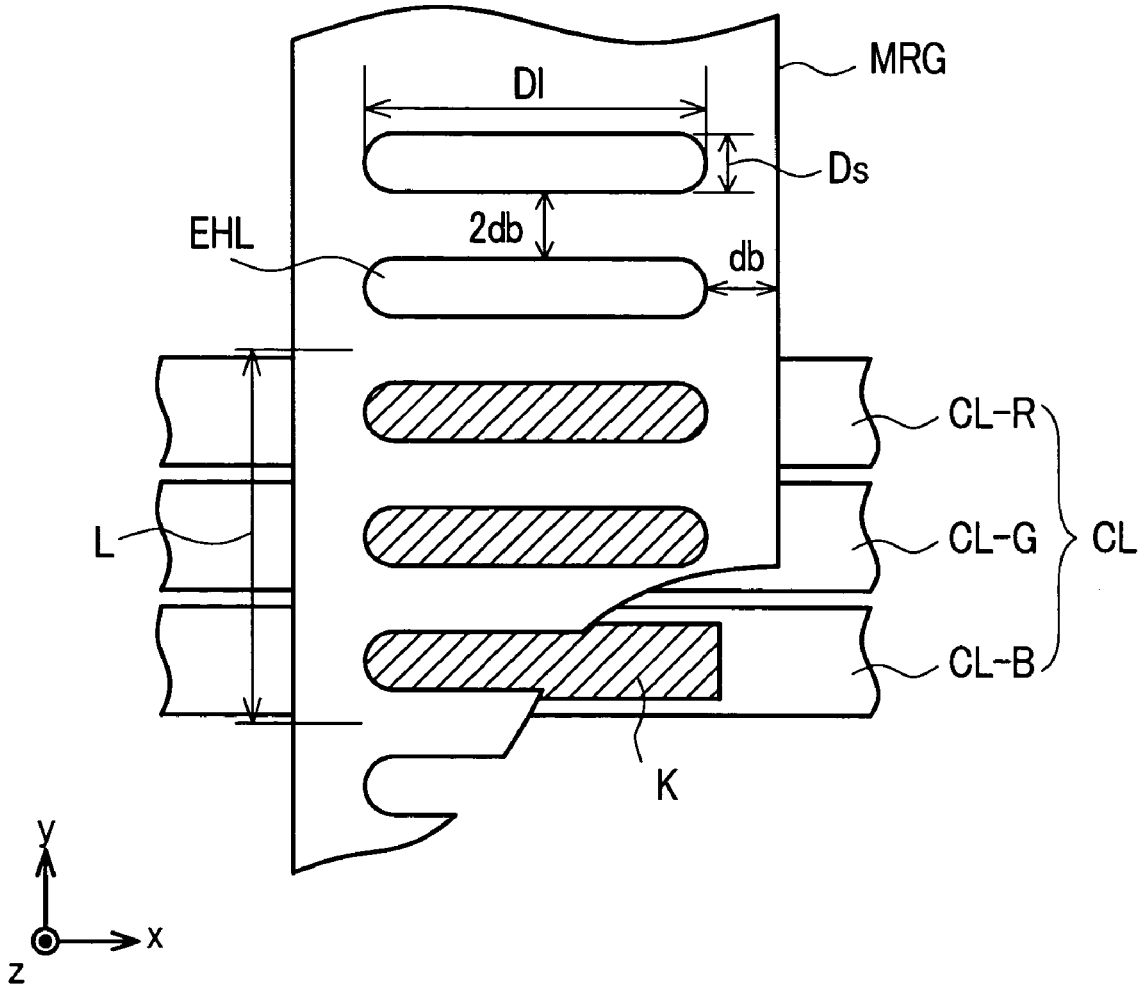
FIG. 13 is a plan view of the vicinity of one pixel for schematically illustrating another embodiment of the image display device according to the present invention.

FIG. 13 is a plan view of the vicinity of one pixel schematically showing still another embodiment of an image display device according to the present invention. The image display device according to this embodiment has substantially the same constitution as the above-mentioned embodiment except for the shape of the electron passing apertures formed in the strip-like electrode elements MRG which constitute the control electrodes. Accordingly, an explanation of the structural features of this embodiment which overlap the corresponding structural features of the previously-mentioned embodiment will be omitted. Slit-like electron passing apertures EHL are formed in the strip-like electrode element MRG in this embodiment. Here, although an explanation will be made hereinafter relating to a case in which one el ctron passing aperture is formed in each cathode line CL-R, CL-G and CL-B, this embodiment is also applicable to a case in which there are a plurality of slit-like electron passing apertures, which are discontinuous in the long-diameter direction (x direction), or a case in which one or a plurality of slit-like electron passing apertures are arranged in the long-diameter direction (x direction) and a plurality of slit-like electron passing apertures are arranged in the short-diameter direction (y direction).

As can be understood from the foregoing explanation of the above-mentioned embodiment having circular electron passing apertures, it becomes apparent that it is necessary to balance two factors consisting of the numerical aperture of the strip-like electrode element MRG and the current density to obtain the maximum current. This is also applicable to a case in which the electron passing apertures are formed in a slit shape (also an elongated circular shape, a rectangular shape).

In driving the image display device using these slit-like electron passing apertures, scanning pulses are inputted to the strip-like electrode elements which constitute the control electrodes, and signals for display are supplied to the cathode lines CL (CL-R, CL-G, CL-B). As has been explained previously, it is desirable that the maximum values of the scanning pulse voltage and the signal voltage are made as extremely small as possible in order to achieve an enhancement of the reliability of the driving circuit, a reduction in cost and the like.

Figure 14:
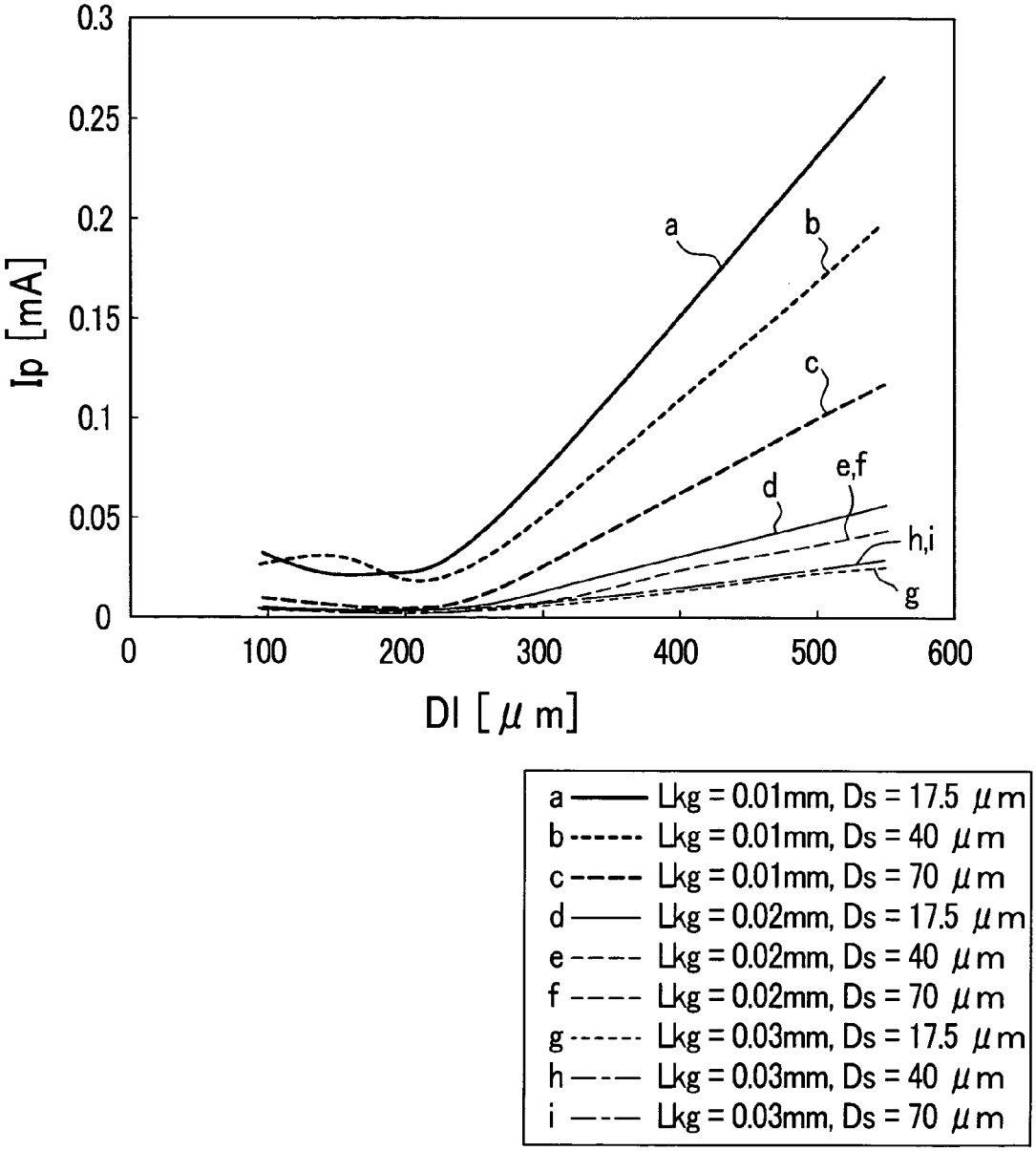
FIG. 14 is a graph showing a result obtained by analyzing current values per one pixel with respect to a short diameter Ds and a large diameter D1 using an electron beam locus simulator under the condition that the maximum values of the scanning pulse voltage and the signal voltage are 40 V (the maximum voltage difference 80 V between the control electrode and the cathode)

To satisfy this requirement, FIG. 14 shows a result obtained by analyzing current values Ip per one sub pixel with respect to a short diameter Ds and a large diameter D1 using an electron beam locus simulator under the condition that the maximum values of the scanning pulse voltage and the signal voltage are 40 V (the maximum voltage difference 80 V between the control electrode and the cathode). In FIG. 14, the long diameter D1 is taken on an axis of abscissas and the cathode-control electrode distance Lkg and the short diameter Ds are adopted as parameters. The analysis conditions other than the short distance Ds, the long distance D1 and the cathode-control electrode distance Lkg are set such that the anode-control electrode distance Lag is 3.0 mm, the anode voltage is 10 kV and the control electrode voltage is 80 V.

As seen from FIG. 14, by fixing the cathode-control electrode distance Lkg and the short diameter Ds, the larger the long diameter D1, the larger will be the current. Accordingly, it is desirable that the long distance DI assumes the maximum size which can ensure the desired pixel size.

Figure 15:
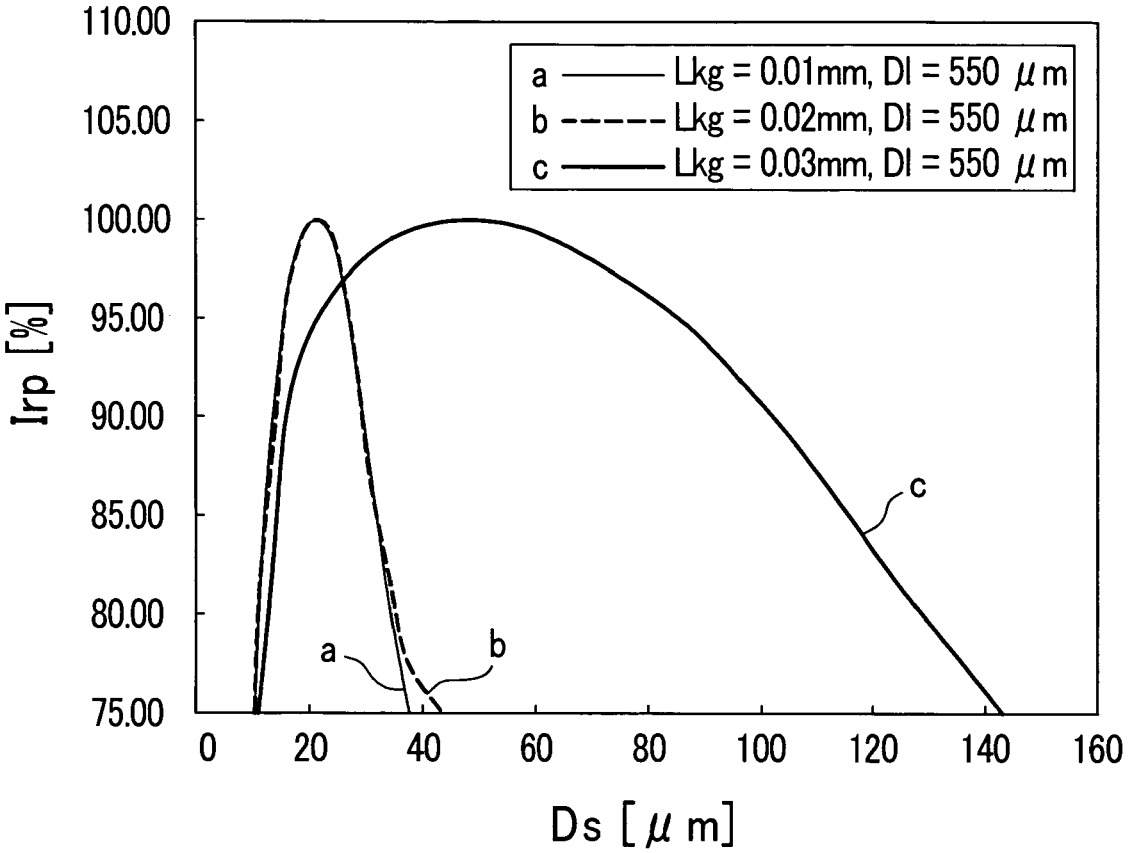
FIG. 15 is a graph showing the maximum current value with respect to the short diameter Ds when the long diameter D1 assumes the maximum value DI=0.550 mm within a range of the simulation shown in FIG. 14.
Figure 16:
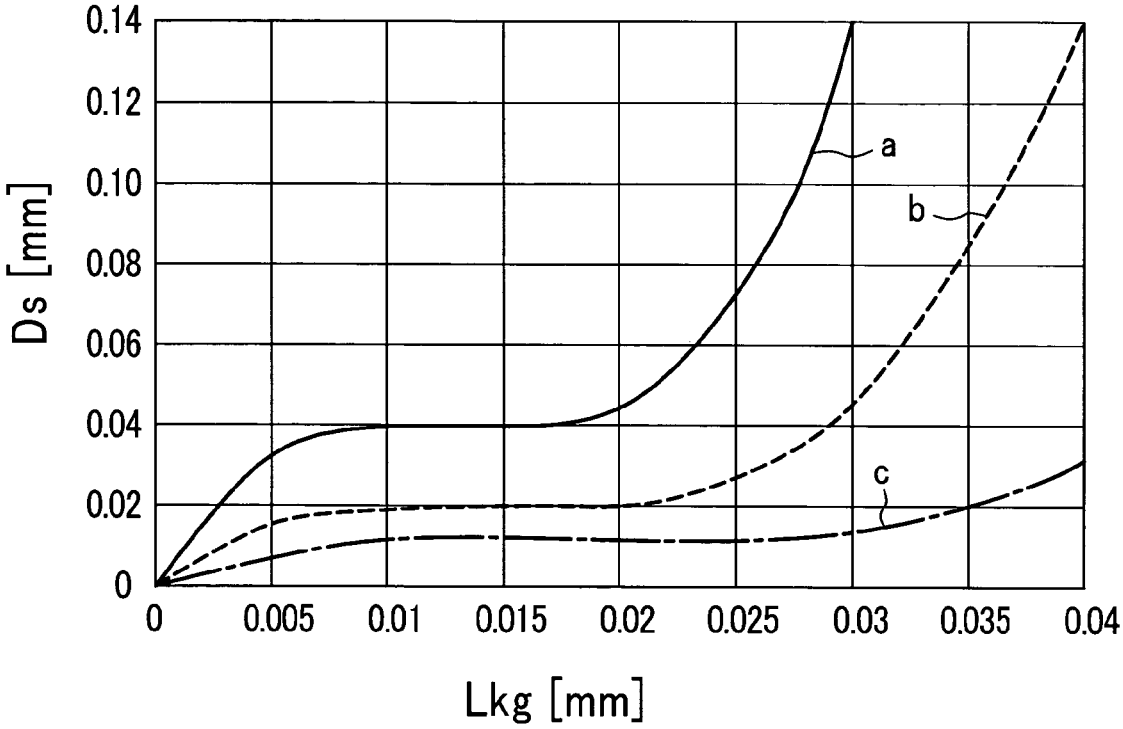
FIG. 16 is a graph showing a range of short diameter Ds which can ensure a current of equal to or more than 75% of a peak value current with respect to a distance Lkg between a cathode and a control electrode.

FIG. 15 is a graph showing the maximum current value (relative value) Irp per one sub pixel with respect to the short diameter Ds when the long diameter DI assumes the maximum value DI=0.550 mm within a range of the simulation shown in FIG. 14. FIG. 16 is a graph showing the range of the short diameter Ds which can ensure a current that is equal to or more than 75% of the peak value current with respect to a cathode-control electrode distance Lkg. "A range of the short diameter which can ensure a current value equal to or more than 75% of the maximum current value in the optimum aperture diameter" is a concept which is substantially equal to the concept explained in conjunction with FIG. 6 to FIG. 10. By applying the least square method to the characteristics obtained in view of FIG. 16, the optimum short diameter, by which the maximum current is obtained, and the minimum and the maximum short diameter, by which a current value equal to or more than 75% of the maximum current value is obtained, are given by the following formulae (39).

optimum short diameter: (39)

$$Ds = 7670 \cdot Lkg^3 - 330 \cdot Lkg^2 + 4.53 \cdot Lkg$$

minimum short diameter:

$$Ds = 2170 \cdot Lkg^3 - 120 \cdot Lkg^2 + 2.08 \cdot Lkg$$

maximum short diameter:

$$Ds = 21400 \cdot Lkg^3 - 815 \cdot Lkg^2 + 9.92 \cdot Lkg$$

On the other hand, assuming a diagonal screen size of D(mm), the number of pixels in the x direction as Nh and the number of pixels in the v direction as Nv, the size L of one side of a single pixel is given by the following formula (40). Here, the aspect ratio of the single pixel is 1:1.

$$L = \frac{D}{\sqrt{Nh^2 + Nv^2}} \tag{40}$$

Since the short-side (y direction) size Lp of a sub pixel is ⅓ of the size L of one side in the y direction of a color pixel, the size Lp is expressed by the following formula (41).

$$L_p = \frac{D}{3 \cdot \sqrt{Nh^2 + Nv^2}} \tag{41}$$

Since the larger long diameter D1 is more advantageous for the image display device, it is advantageous to take the long diameter D1 in the direction of the size L of one side of the one color pixel. Accordingly, the long diameter D1 is defined by the size L of one side of one color pixel and the short diameter Ds is defined by the short-side size Lp of a sub pixel and the distance (bridge) db between the electron passing apertur s formed in the control electrode (strip-like electrode element MRG). Further, in manufacturing the control electrodes, the bridge db portions become necessary at least at both sides of the electron passing aperture.

From the above, the long diameter DI and the short diameter Ds are expressed by the following three formulae (42), (43) and (44). When these three formulae are satisfied, the optimum design is obtained.

$$Dl \leq \frac{D}{\sqrt{Nh^2 + Nv^2}} - 2db \tag{42}$$

$$Ds \leq \frac{D}{3 \cdot \sqrt{Nh^2 + Nv^2}} - 2db \tag{43}$$

$$2170 \cdot Lkg^3 - 120 \cdot Lkg^2 + 2.08 \cdot Lkg \leqq Ds \leqq 21400 \cdot Lkg^3 - 815 \cdot Lkg^2 + 9.92 \cdot Lkg \tag{44}$$

Figure 17:
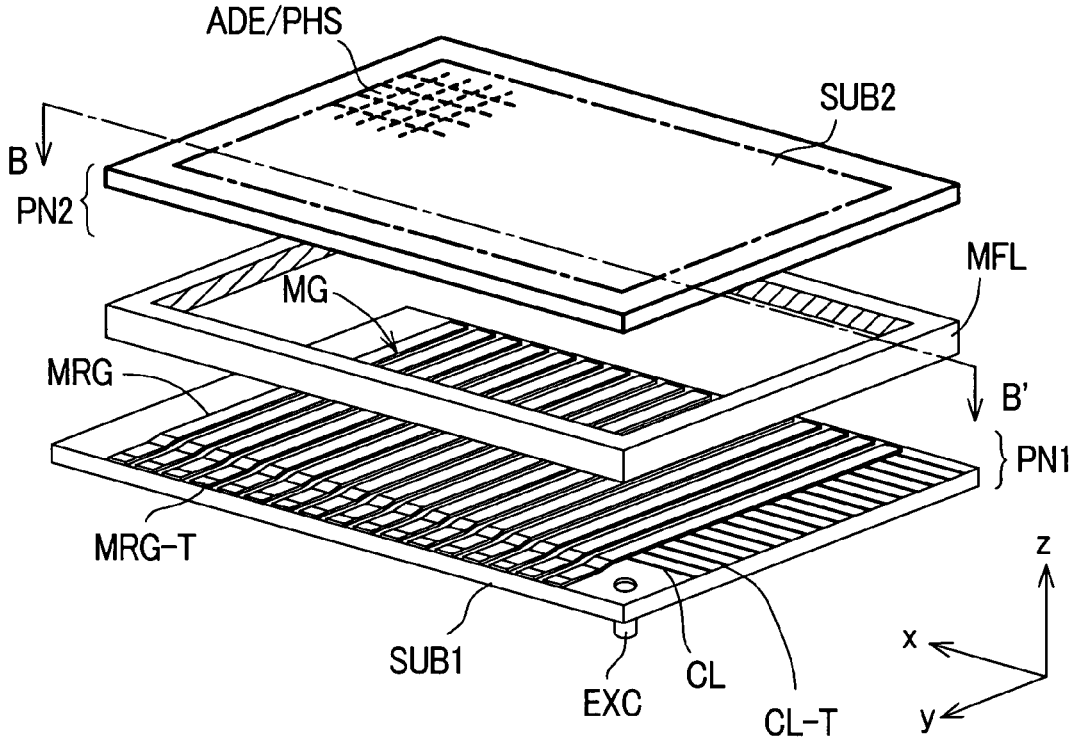
FIG. 17 is a developed perspective view illustrating one example of the overall constitution of the image display device according to the present invention.

FIG. 17 is a developed perspective view showing one example of the overall constitution of the image display device according to the present invention. Further, FIG. 18 is a cross-sectional view taken along a line B–B' in FIG. 17.

Figure 18:
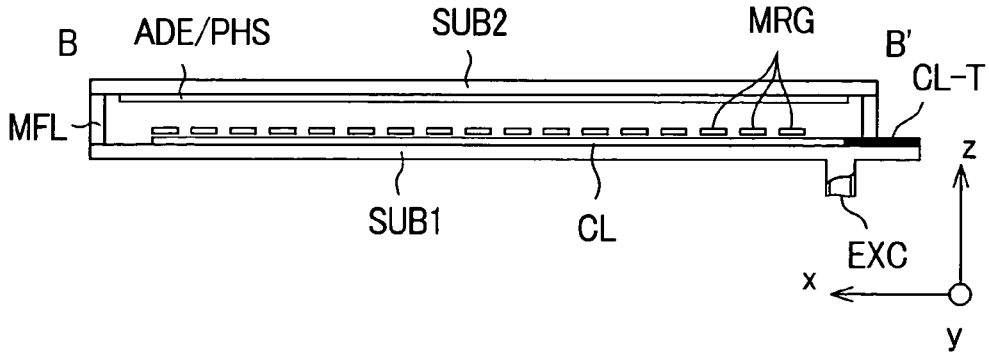
FIG. 18 is a cross-sectional view taken along a line B–B' in FIG. 17.

In FIG. 17 and FIG. 18, reference symbol PN1 indicates a back panel, reference symbol PN2 indicates a face panel, reference symbol SUB1 indicates a back substrate, reference symbol SUB2 indicates a face substrate, reference symbol CL indicates cathode lines, reference symbol CL-T indicates cathode-line lead lines, reference symbol MG indicates control electrodes, reference symbol MRG indicates strip-like electrode elements which constitute the control electrodes MG, reference symbol MRG-T indicates control electrode lead lines, reference symbol MFL indicates a sealing frame, and reference symbol EXC indicates an exhaust pipe.

In FIG. 17 and FIG. 18, on an inner surface of the back substrate SUB1, which constitutes a main element of the back panel PN1, a large number of cathode lines CL, which extend in a first direction (x direction) and are arranged in parallel in a second direction (y direction) which intersects the above-mentioned first direction, have electron sources (here, carbon nanotubes, not shown in the drawing) which are formed by printing a conductive material, such as a silver paste or the like. Above the cathode lines CL, the control electrodes MG, which intersect the cathode lines CL in a non-contact manner, extend in the y direction and are arranged in parallel in the x direction. The control electrodes MG are formed of a large number of strip-like electrode elements MRG which are arranged in parallel, wherein each electrode element MRG has electron passing apertures (not shown in the drawing) which allow electrons from electron sources (not shown in the drawing) provided on each cathode line CL to pass therethrough to the face substrate SUB2 side, which constitutes the main element of the face panel PN2. Pixels are formed at portions where the cathode lines CL and the strip-like electrode elements intersect each other. On the other hand, to an inner surface of the face panel PN2, fluorescent materials PHS are applied corresponding to the pixels on the back panel PN1, and anodes ADE are formed as films. A display region is formed of a region of the face panel PN2 where the fluorescent materials and the anodes are formed.

The control el ctrod s MG of this embodiment are formed of a thin plate made of iron-based stainless steel or an iron material. A plate thickness of the control electrodes MG is approximately 0.025 mm to 0.150 mm, for example. A large number of parallel strip-like electrode elements MRG are formed by machining this thin plate using a photolithography method or the like. In portions of the respective strip-like electrode elements MRG which face the above-mentioned electron sources, a plurality of electron passing apertures (not shown in the drawing) are formed. End portions of the control electrodes MG which are constituted of the strip-like electrode elements MRG are fixed to the back substrate SUB1 using a sealing material MFL or other fixing members. In this embodiment, although the cathode-line lead lines CL-T and the control-electrode lead lines MRG-T are lead out to respective sides of the back substrate SUB1, it may be possible to adopt a constitution in which one or both of them are lead out to opposite sides.

Then, to the back panel PN1 on which the constitutional members, such as the cathode lines CL, the control electrodes MG (strip-like electrode elements RG) and the like are mounted, the face panel PN2 is fixed by way of a sealing frame MFL in an overlapped manner. It is preferable to insert an adhesive agent, such as frit glass, into bonding portions of the back panel PN1, the sealing frame MFL and the face panel PN2.

As has been described heretofore, according to the present invention, by defining the given relationships among the diagonal screen size of the display region formed on the face substrate, the number of pixels which are arranged in one direction (for example, long-side direction, for example, x direction, for example, horizontal direction), the number of pixels which are arranged in anoth r direction (for example, short-side direction, for example, y direction, for example, vertical direction), the distance between electron passing apertures formed in the strip-like electrode elements which constitute the control electrodes, the distance between the electron sources and the strip-like electrode elements, the aperture diameter (in case of circular aperture) of the electron passing apertures, or between the long diameter and the short diameter (in case of slit-like apertures), the aperture diameter of the electron passing apertures is made as small as possible, or the slits are made as narrow as possible, whereby it is possible to provide a high-quality image display device in which the mechanical strength of the control electrodes can be ensured and a high current density at low-voltage driving can be realized.

What is claimed is:

1. An image display device comprising:

a rectangular face substrate which has an inner surface on which anodes and fluorescent materials are formed and on which a display region is formed which has two parallel sides in one direction and two parallel sides in another direction that is orthogonal to the one direction;

a back substrate which forms a plurality of cathode lines which extend in one direction and are arranged in another direction in parallel and have electron sources thereon, and control electrodes which intersect the cathode lines in a non-contacting manner at least inside of the display region, extend in another direction and are arranged in the one direction in parallel, thus forming pixels at intersections with the cathode lines on an inner surface thereof, wherein the control electrodes are formed by arranging in parallel a plurality of mutually independent strip-like electrode elements each having one or a plurality of circular electron passing apertures which allow electrons from the electron sources to pass therethrough to the face substrate side, the back substrate being arranged to face the face substrate with a given gap therebetween; and a sealing frame which is interposed between the face substrate and the back substrate while surrounding the display region in such a way as to maintain the given gap between the face substrate and the back substrate; wherein assuming a diagonal screen size of the display region which is formed on the face substrate as D(mm), the number of pixels which are arranged in one direction as Nh, the number of pixels which are arranged in another direction as Nv, the distance between the electron passing apertures formed in the strip-like electrode elements which constitute the control electrodes as db(mm), the distance between the electron sources and the strip-like electrode elements as Lkg(mm), and an aperture diameter of the electron passing apertures as ϕG(mm), provided that the aperture diameter ϕG(mm) is expressed by the following formula (1), $$\frac{D}{3\cdot\sqrt{Nh^2+Nv^2}}-2db > (-0.23\cdot\ln(db)+0.49)\cdot Lkg+0.02\cdot\ln(db)+0.125 \quad (1)$$

the following formula (2) is established, $$(0.46\cdot\ln(db)+2.5)\cdot Lkg+0.006\cdot\ln(db)+0.04\leqq\phi G\leqq(-0.41\cdot\ln(db)-0.68)\cdot Lkg+0.014\cdot\ln(db)+0.14.5 \quad (2).$$

2. An image display device according to claim 1, wherein the electron sources are made of carbon nanotubes.

3. An image display device according to claim 1, wherein the strip-like control electrodes which constitute the control electrodes are formed of plate-like control electrodes.

4. An image display device according to claim 3, wherein the plate-like control electrode has leg portions which are projected to the back substrate side and the leg portions are formed together with the electron passing apertures by etching.

5. An image display device according to claim 4, wherein individual leg portions are arranged for respective groups of pixels.

6. An image display device according to claim 4, wherein the distance between the electron sources and the strip-like electrode element is defined by a projection quantity of the leg portions at the back substrate side.

7. An image display device comprising:

a rectangular face substrate which has an inner surface on which anodes and fluorescent materials are formed and on which a display region is formed which has two parallel sides in one direction and two parallel sides in another direction that is orthogonal to the one direction;

a back substrate which forms a plurality of cathode lines which extend in one direction and are arranged in another direction in parallel and have electron sources thereon, and control electrodes which intersect the cathode lines in a non-contact manner at least inside of the display region, extend in the one direction and are arranged in another direction in parallel, thus forming pixels at intersections with the cathode lines on an inner surface thereof, wherein the control electrodes are formed by arranging in parallel a plurality of mutually independent strip-like electrode elements each having one or a plurality of circular electron passing apertures which allow electrons from the electron sources to pass therethrough to the face substrate side, the back substrate being arranged to face the face substrate with a given gap therebetween; and a sealing frame which is interposed between the face substrate and the back substrate while surrounding the display region in such a way as to maintain the given gap between the face substrate and the back substrate; wherein assuming a diagonal screen size of the display region which is formed on the face substrate as D(mm), the number of pixels which are arranged in one direction as Nh, the number of pixels which are arranged in another direction as Nv, the distance between the electron passing apertures formed in the strip-like electrode elements which constitute the control electrodes as db(mm), the distance between the electron sources and the strip-like electrode elements as Lkg(mm), and an aperture diameter of the electron passing apertures as ϕG(mm), provided that the aperture diameter ϕG(mm) is expressed by a following formula (3), $$\frac{D}{3\cdot\sqrt{Nh^2+Nv^2}}-2db \leq (-0.23\cdot\ln(db)+0.49)\cdot Lkg+0.02\cdot\ln(db)+0.125 \quad (3)$$

the following formula (4) is established, $$\phi G_{\min} \leq \phi G \leq \frac{D}{3\cdot\sqrt{Nh^2+Nv^2}}-2db \quad (4)$$

and wherein the aperture diameter ϕG(mm) is expressed by the following formula (5)

$$\frac{3}{4}\left(\frac{D}{3\cdot\sqrt{Nh^2+Nv^2}}-2db\right) \quad (5)$$

or by a following formula (6), $$(0.46\cdot\ln(db)+2.5)\cdot Lkg+0.006\cdot\ln(db)+0.04 \quad (6)$$

assuming a diagonal screen size of the display region which is formed on the face substrate as D(mm), the number of pixels which are arranged in one direction as Nh, the number of pixels which are arranged in another direction as Nv, the distance between the electron passing apertures formed in the strip-like electrode elements which constitute the control electrodes as db(mm), the distance between the electron sources and the strip-like electrode elements as Lkg(mm), a long diameter of the electron passing apertures as DI(mm), and a short diameter of the electron passing apertures as Ds(mm), the long distance DI (mm) of the electron passing aperture having the slit shape is expressed by the following formula (7), $$Dl \leq \frac{D}{\sqrt{Nh^2+Nv^2}}-2db \quad (7)$$

the short distance Ds (mm) of the electron passing aperture is expressed by the following formula (8), $$Ds \leq \frac{D}{3\cdot\sqrt{Nh^2+Nv^2}}-2db \quad (8)$$

the following formula (9) is established, $$2170\cdot Lkg^3-120\cdot Lkg^2+2.08\cdot Lkg \leqq Ds \leqq 21400\cdot Lkg^3-815\cdot Lkg^2+9.92\cdot Lkg \quad (9).$$

* * * * *